United States Patent [19]

Hiraishi et al.

[11] Patent Number: 4,880,767

[45] Date of Patent: Nov. 14, 1989

[54] RECORDING MATERIAL

[75] Inventors: Shigetoshi Hiraishi, Tokyo; Mitsuru Fuchigami; Masahiro Miyauchi, both of Takasago; Kazuo Kabashima, Yokohama, all of Japan

[73] Assignees: Mitsubishi Paper Mills, Tokyo; Asahi Kasei Kogyo Kabushiki Kaisha, Osaka, both of Japan

[21] Appl. No.: 122,191

[22] Filed: Nov. 18, 1987

[30] Foreign Application Priority Data

Nov. 18, 1986 [JP] Japan ..... 61-273009

[51] Int. Cl.[4] ..... B41M 5/16; B41M 5/18; B41M 5/22

[52] U.S. Cl. ..... 503/217; 427/150; 427/151; 427/152; 428/913; 428/914; 503/204; 503/218; 503/221; 503/225

[58] Field of Search ..... 427/150, 151, 152; 503/216–218, 221, 225, 204; 428/913, 914

[56] References Cited

U.S. PATENT DOCUMENTS 4,521,793 6/1985 Kabashima et al. ..... 503/217

FOREIGN PATENT DOCUMENTS 61-175077 of 0000 Japan ..... 503/217

*Primary Examiner*—Bruce H. Hess

*Attorney, Agent, or Firm*—Cushman, Darby & Cushman

[57] ABSTRACT

A recording material wherein a color forming system comprising (a) a fluorene compound as a dye precursor, (b) a color developer, (c) an isocyanate compound, and (d) an imino compound, gives a developed color image having an absorption at near infrared portion and excellent image storability.

9 Claims, No Drawings

RECORDING MATERIAL

BACKGROUND OF THE INVENTION

This invention relates to a two-component color forming type recording material having absorptions particularly at near infrared portion and giving developed color images excellent in storability.

As recording materials applying a two-component color forming system comprising a colorless or light-colored dye precursor and a color developer which can form a color in contact with the dye precursor, there are well known pressure-sensitive recording materials, and heat-sensitive recording materials. Demand for these materials increases year after year. Further, electric current-passing heat-sensitive recording materials, light-sensitive recording materials, heat transfer recording materials are also developed recently.

Heat-sensitive recording materials generally comprise a support and formed thereon a color forming layer containing as major components an electron donative colorless or light-colored dye precursor and an electron accepting color developer. Upon heating with a thermal head, a thermal pen, a laser light, or the like, the dye precursor and the color developer react instantly to give a recording image (e.g. Japanese Patent Examined Publication Nos. 43-4160 and 45-14039). Since these heat-sensitive recording materials have advantages in that recording can be obtained by using a relatively simple apparatus, the maintenance is easy and no noise is produced, they are widely used in recorders for measuring, facsimile machines, printers, computer terminals, labels, automatic ticket vending machines, etc.

Particularly, heat-sensitive recording labels are used as bar code labels for point of sales (POS) system, price labels, delivery and skipping labels and the like, wherein adhering is necessary after printing. The POS system remarkably spreads in large-scale stores such as supermarkets and department stores as well as chain stores of special stores, restaurants, etc. In order to grasp the needs of consumers clearly and to plan reasonable business strategy, it is an object to totalize and analyze sales information of goods. In order to attain such an object, methods for reading bar codes and OCR letters adhered to goods sold in stores with a scanner optically have been developed rapidly. As a method for printing bar codes, etc., there is widely used a heat-sensitive recording method which has advantages in that miniaturization and simplification of the machine is possible, speed up of recording is possible, there is no contamination of hands and goods by the ink, and there is no fear of blur of ink.

As a method for reading developed color images such as bar codes, etc., there has been used a He·Ne laser light having a red color at a wavelength of 633 nm. But recently, the use of a semiconductor laser is widely spreading. This is because it has many advantages in that the modulation can be made directly by an electric current, miniaturization is possible, the use of semiconductor laser is easy with a low cost, erroneous operation due to contamination is rare because the oscillation wavelength is in the near infrared portion of 700 to 1500 nm. Therefore, a demand for reading developed color images in heat-sensitive recording labels by using the semiconductor laser increases. According to known two-component type heat-sensitive recording materials comprising a dye precursor and a color developer, the absorption wavelength of developed color images is, even in a black color-forming system, at a longer wavelength side of 550 to 620 nm which range can be read by a He·Ne laser light but cannot be read by using a laser light having a wavelength at the near infrared portion Some of the present inventors have provided heat-sensitive recording materials readable by a laser light at the near infrared portion (e.g. Japanese Patent Unexamined Publication Nos. 61-175077, 61-228985, 61-228986, etc.), but they are still insufficient in storability of developed color images, particularly insufficient in light resistance.

SUMMARY OF THE INVENTION

It is an object of this invention to provide a recording material giving a developed color image having an absorption at near infrared portion and excellent image storability, particularly excellent in light resistance.

This invention provides a recording material which comprises a color forming layer containing a color forming system comprising (A) (a) a colorless or light-colored dye precursor represented by the formula:

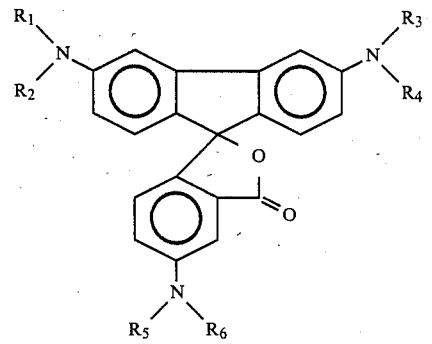

(I)

wherein $R_1$ through $R_6$ are independently a lower alkyl group, (b) a color developer which can form a color by reacting with the dye precursor, and (B) (c) an isocyanate compound having aromaticity, and (d) an imino compound having at least one

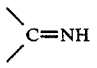

group, said color forming layer being carried on a support or at least two different supports.

DETAILED DESCRIPTION OF THE INVENTION

The colorless or light-colored dye precursor (a) used in this invention is a fluorene compound represented by the formula:

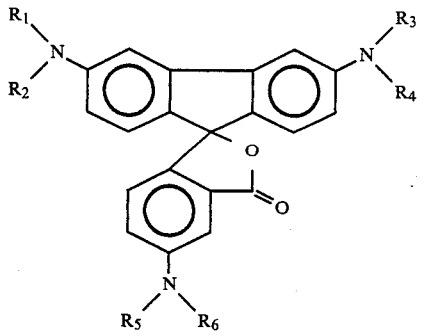

(I)

wherein $R_1$ through $R_6$ are independently a lower alkyl group preferably having 1 to 6 carbon atoms. The fluorene compound of the formula (I) is a colorless or light-colored crystal and has no absorption at the near infrared portion. But when it is reacted with a color developer, a color from blue to green is formed and the developed color image has an absorption at the near infrared portion.

Examples of the fluorene compound of the formula (I) are 3,6-bis(dimethylamino)fluorene-9-spiro-3'-(6'-dimethylaminophthalide), 3-diethylamino-6-dimethylaminofluorene-9-spiro-3'-(6'-dimethylaminophthalide), 3,6-bis(diethylamino)fluorene-9-spiro-3'-(6'-dimethylaminophthalide), 3-dibutylamino-6-dimethylaminofluorene-9-spiro-3'-(6'-dimethylaminophthalide), 3-dibutylamino-6-diethylaminofluorene-9-spiro-3'-(6'-dimethylaminophthalide), 3,6-bis(dimethylamino)fluorene-9-spiro-3'-(6'-diethylaminophthalide), 3-diethylamino-6-dimethylaminofluorene-9-spiro-3'-(6'-diethylaminophthalide), 3-dibutylamino-6-dimethylaminofluorene-9-spiro-3'-(6'-diethylaminophthalide), 3,6-bis(diethyl- amino)fluorene-9-spiro-3'-(6'-diethylaminophthalide), 3,6-bis(dimethylamino)fluorene-9-spiro-3'-(6'-dibutylaminophthalide), 3-dibutylamino-6-diethylaminofluorene-9-spiro-3'-(6'-diethylaminophthalide), 3-diethylamino-6-dimethylaminofluorene-9-spiro-3'-(6'-dibutylaminophthalide), etc. These fluorene compounds can be used alone or as a mixture thereof.

The color developer (b) which can form a color by reacting with the fluorene compound with heating is an electron-accepting compound such as phenol derivatives, aromatic carboxylic acid derivatives, etc.

Examples of the phenol derivatives are phenol, p-t-butylphenol, p-phenylphenol, 1-naphthol, 2-naphthol, p-hydroxyacetophenone, 2,2'-dihydroxybiphenyl, 4,4'-isopropylidenediphenol, 4,4'-isopropylidene-bis(2-t-butylphenol), 4,4'-isopropylidenebis(2-chlorophenol), 4,4'-cyclohexylidenediphenol, 2,2-bis(4-hydroxyphenyl)-butane, 2,2-bis(4-hydroxyphenyl)pentane, 2,2-bis(4-hydroxyphenyl)hexane, methyl diphenolacetate, 1,7-bis-(4-hydroxyphenylthio)-3,5-dioxiheptane, novolac type phenol resin, etc.

Examples of the aromatic carboxylic acid derivatives are benzoic acid, p-t-butyl benzoate, p-hydroxybenzoic acid, methyl p-hydroxybenzoate, isopropyl p-hydroxybenzoate, benzyl p-hydroxybenzoate, lauryl gallate, stearyl gallate, salicylanilide, 5-chlorosalicylanilide, a metal salt (e.g. Zn) of 5-t-butyl salicylate, a metal salt (e.g. Zn) of hydroxynaphthoic acid, etc.

It is also possible to use sulfone compounds and sulfide compounds preferably. Examples of the sulfone and sulfide compounds are bis(4-hydroxyphenyl)-sulfone, 4-hydroxy-4'-methyldiphenylsulfone, 4-hydroxy-4'-isopropyloxydiphenylsulfone, bis(3-allyl-4-hydroxyphenyl)sulfone, bis(3-methyl-4-hydroxyphenyl)sulfone, bis(3-butyl-4-hydroxyphenyl)sulfone, bis(3,5-diallyl-4-hydroxyphenyl)sulfone, bis(3-chloro-4-hydroxyphenyl)sulfone, 3-allyl-4,4'-dihydroxydiphenylsulfone, bis(2-ethyl-4-hydroxyphenyl)sulfone, 3-isopropyl-4,4'-dihydroxydiphenylsulfone, bis(2,5-dimethyl-4-hydroxyphenyl)sulfone, bis(2,5-dichloro-4-hydroxyphenyl)sulfone, 4,4'-thiobis(2,5-dichlorophenol), 4,4'-thiodiphenol, 2,2'-thiobis(4-chlorophenol), 2,2'-thiobis(4,6-dichlorophenol), 4,4'-thiobis(2,6-dimethylphenol), 4,4'-thiobis(2,5-dimethylphenol), 4,''-thiobis(2-isopropyl-5-methylphenol), 4,4'-thiobis(2-cyclohexylphenol), 4,4'-thiobis(2-isopropylphenol), 4,4'-thiobis(3-ethylphenol), 4,4'-thiobis(2-t-butyl-5-methylphenol), etc.

The isocyanate compound having aromaticity (c) includes aromatic isocyanates and heterocyclic isocyanates which are solid at room temperature and colorless or light-colored.

Examples of the isocyanate compounds are 2,6-dichlorophenyl isocyanate, p-chlorophenyl isocyanate, 1,3-phenylene diisocyanate, 1,4-phenylene diisocyanate, 1,3-dimethylbenzene 4,6-diisocyanate, 1,4-dimethylbenzene 2,5-diisocyanate, 1-methoxybenzene 2,4-diisocyanate, 1-methoxybenzene 2,5-diisocyanate, 1-ethoxybenzene 2,4-diisocyanate, 2,5-dimethoxybenzene 1,4-diisocyanate, 2,5-diethoxybenzene 1,4-diisocyanate, 2,5-dibutoxybenzene 1,4-diisocyanate, azobenzene 4,4'-diisocyanate, diphenyl ether 4,4'-diisocyanate, naphthalene 1,4-diisocyanate, naphthalene 1,5-diisocyanate, naphthalene 2,6-diisocyanate, naphthalene 2,7-diisocyanate, 3,3'-dimethylbiphenyl 4,4'-diisocyanate, 3,3'-dimethoxybiphenyl 4,4'-diisocyanate, diphenylmethane 4,4'-diisocyanate, diphenyldimethylmethane 4,4'-diisocyanate, benzophenone 3,3'-diisocyanate, fluorene 2,7-diisocyanate, anthraquinone 2,6-diisocyanate, 9-ethylcarbazole 3,6-diisocyanate, pyrene 3,8-diisocyanate, naphthalene 1,3,7-triisocyanate, biphenyl 2,4,4'-triisocyanate, 4,4',4''-triisocyanate-2,5-dimethoxytriphenylamine, p-dimethylaminophenyl isocyanate, tris(4-phenyl isocyanate) thiophosphate, etc. These isocyanate compounds can be used alone or as a mixture thereof.

If necessary, these isocyanate compounds can be used in the form of so-called block isocyanates, which are adducts of phenols, lactams, oximes, and the like. It is also possible to use dimers of diisocyanates such as a dimer of 1-methylbenzene 2,4-diisocyanate, isocyanurates which are trimers of diisocyanates and various polyisocyanates which are adducts with various polyols.

The imino compound having at least one

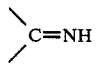

group (d) is a compound represented by the formula:

$$\phi C{=}NH \qquad \text{(II)}$$

wherein $\phi$ is an aromatic compound residue which can form a conjugated system with the neighboring C=N, and is solid at room temperature and colorless or light-colored.

Examples of the imino compound are 3-iminoisoindolin-1-one, 3-imino-4,5,6,7-tetrachloroisoindolin-1-one, 3-imino-4,5,6,7-tetrabromoisoindolin-1-one, 3-imino-4,5,6,7-tetrafluoroisoindolin-1-one, 3-imino-5,6-dichloroisoindolin-1-one, 3-imino-4,5,7-trichloro-6-methoxy-isoindolin-1-one, 3-imino-4,5,7-trichloro-6-methylmercapto-isoindolin-1-one, 3-imino-6-nitroisoindolin-1-one, 3-imino-isoindolin-1-spiro-dioxolane, 1,1-dimethoxy-3-imino-isoindoline, 1,1-diethoxy-3-imino-4,5,6,7-tetrachloroisoindoline, 1-ethoxy-3-iminoisoindoline, 1,3-diiminoisoindoline, 1,3-diimino-4,5,6,7-tetrachloroisoindoline, 1,3-diimino-6-methoxyisoindoline, 1,3-diimino-6-cyanoisoindoline, 1,3-diimino-4,7-dithia-5,5,6,6-tetrahydroisoindolone, 7-amino-2,3-dimethyl-5-oxopyrro[ 3,4b]pyrazine, 7-amino-2,3-diphenyl-5-oxopyrro[3,4b]pyrazine, 1-iminonaphthalic acid imide, 1-iminodiphenic acid imide, 1-phenylimino-3-iminoisoindoline, 1-(3'-chlorophenylimino)-3-iminoisoindoline, 1-(2',5'-dichlorophenylimino)-3-iminoisoindoline, 1-(2',4',5'-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-nitrophenylimino)-3-iminoisoindoline, 1-(2',5'-dimethoxyphenylimino)-3-iminoisoindoline, 1-(2',5'-diethoxyphenylimino)-3-iminoisoindoline, 1-(2'-methyl-4'-nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3',N,N-dimethylamino-4'-methoxyphenylimino)-3-iminoisoindoline, 1-(2'-methoxy-5'-N-phenylcarbamoylphenylimino)-3-iminoisoindoline, 1-(2'-chloro-5'-trifluoromethylphenylimino)-3-iminoisoindoline, 1-(5',6'-dichlorobenzothiazolyl-2'-imino)-3-iminoisoindoline, 1-(6'-methylbenzothiazolyl-2'-imino)-3-iminoisoindoline, 1-(4'-phenylaminophenylimino)-3-iminoisoindoline, 1-(p-phenylazophenylimino)-3-iminoisoindoline, 1-(naphthyl-1'-imino)-3-iminoisoindoline, 1-(anthraquinone-1'-imino)-3-iminoisoindoline, 1-(5'-chloroanthraquinone-1'-imino)-3-iminoisoindoline, 1-(N-ethylcarbazolyl-3'-imino)-3-iminoisoindoline, 1-(naphthoquinone-1'-imino)-3-iminoisoindoline, 1-(pyridyl-4'-imino)-3-iminoisoindoline, 1-(benzimidazolone-6'-imino)-3-iminoisoindoline, 1-(1'-methylbenzimidazolone-6'-imino)-3-iminoisoindoline, 1-(7'-chlorobenzimidazolone-5'-imino)-3-iminoisoindoline, 1-(benzimidazolyl-2'-imino)-3-iminoisoindoline, 1-(benzimidazolyl-2'-imino)-3-imino-4,5,6,7-tetrachloroisoindoline, 1-(2',4'-dinitrophenylhydrazone)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzimidazolyl-2'-imino)-3-imino-4,7-dithiatetrahydroisoindoline, 1-(4',5'-dicyanoimidazolyl-2'-imino)-3-imino-5,6-dimethyl-4,7-pyraziisoindoline, 1-(cyanobenzoylmethylene)-3-iminoisoindoline, 1-(cyanocarbonamidomethylene)-3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-3-iminoisoindoline, 1-[cyano-N-(3'-methylphenyl)-carbamoylmethylene]-3-iminoisoindoline, 1-[cyano-N-(4'-chlorophenyl)-carbamoylmethylene]-3-iminoisoindoline, 1-[cyano-N-(4'-methoxyphenyl)-carbamoylmethylene]-3-iminoisoindoline, 1-[cyano-N-(3'-chloro-4'-methylphenyl)-carbamoylmethylene]-3-iminoisoindoline, 1-(cyano-p-nitrophenylmethylene)-3-iminoisoindoline, 1-(dicyanomethylene)-3-iminoisoindoline, 1-(cyano-1',2',4'-triazolyl-(3')-carbamoylmethylene)-3-iminoisoindoline, 1-(cyanothiazoyl-(2')-carbamoylmethylene)-3-iminoisoindoline, 1-(cyanobenzimidazolyl-(2')-carbamoylmethylene)-3-iminoisoindoline, 1-(cyanobenzothiazolyl)-(2')-carbamoylmethylene) -3-iminoisoindoline, 1-[(cyanobenzimidazolyl-2')-methylene]-3-iminoisoindoline, 1- (cyanobenzimidazolyl-2')-methylene]-3-imino-4,5,6,7-tetrachloroisoindoline, 1-[(cyanobenzimidazolyl-2')-methylene]-3-imino-5-methoxyisoindoline, 1-[(cyanobenzimidazolyl-2')-methylene]-3-imino-6-chloroisoindoline, 1-[(1'-phenyl-3'-methyl-5-oxo)-pyrazolidene-4']-3-iminoisoindoline, 1-[(cyanobenzimidazolyl-2')-methylene]-3-imino-4,7-dithiatetrahydroisoindoline, 1-[(cyanobenzimidazolyl-2')-methylene]-3-imino-5,6-dimethyl-4,7-pyraziisoindoline, 1-[(1'-methyl-3'-n-butyl)-barbituric acid-5']-3-iminoisoindoline, 3-imino-1-sulfobenzoic acid imide, 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-ix'ino-1-sulfo-4,5,6,7-tetrabromobenzoic acid imide, 3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-2-methyl-4,5,6,7-tetrachloroisoindolin-1-one, etc. These imino compounds can be used alone or as a mixture thereof.

The color developer (b) is used in an amount of 20 to 500% by weight, preferably 50 to 300% by weight based on the weight of the dye precursor (a). The imino compound (d) and the isocyanate compound (c) are used in amounts of 1% by weight or more, preferably 5 to 200% by weight, respectively, based on the weight of the dye precursor (a). When the amounts of the imino compound and the isocyanate compound are less than 1% by weight, respectively, the effects are insufficient. On the other hand, when the amounts of the imino compound and the isocyanate compound are more than 200% by weight, respectively, almost the same effects cannot be expected and the developed color image density is often lowered undesirably.

The heat-sensitive recording materials disclosed in U.S. Pat. No. 4,521,793 contain a two-component color forming system comprising an imino compound and an isocyanate compound, said color forming system forming a color by a reaction with heating. The resulting developed color image is excellent in image storability but does not show absorption in the near infrared portion when examined by spectral absorption. On the other hand, the two-component type heat-sensitive recording material using a fluorene dye precursor disclosed in Japanese Patent Unexamined Publication No. 61-175077 gives a developed color image which has an absorption in the near infrared portion but is insufficient in image storability.

It is a very surprising thing that unexpected excellent properties are obtained when the two-component color forming system of the former and that of the latter are used together. That is, when the developed color image obtained from the fluorene dye precursor and a color developer is exposed to sunlight, the image is deteriorated in a short time to lose a sufficient absorption in the near infrared portion. But when the color forming system comprising an imino compound and an isocyanate compound is used together with the fluorene dye precursor and the color developer, the resulting image maintains the absorption in the near infrared portion when exposed to sunlight for a long period of time. This means that the developed color image obtained from the fluorene dye precursor is remarkably prevented from the deterioration by the mutual action of the imino compound and the isocyanate compound. The mechanism of this is not known yet, but this is a very specific phenomenon.

In the recording material of this invention, a color forming layer may further contain the following components in addition to the color forming components depending on purposes.

As a binder, there can be used water-soluble binders such as starches, hydroxyethyl cellulose, methyl cellulose, carboxymethyl cellulose, gelatin, casein, polyvinyl alcohol, modified polyvinyl alcohol, styrenemaleic anhydride copolymer, ethylene-maleic anhydride copolymer, and the like; and latex type water-soluble binders such as styrene-butadiene copolymer, acrylo- nitrile-butadiene copolymer, methyl acrylate-butadiene copolymer, and the like.

As a pigment, there can be used diatomaceous earth, talc, kaolin, calcined kaolin, calcium carbonate, magnesium carbonate, titanium oxide, zinc oxide, silicon oxide, aluminum hydroxide, urea-formaldehyde resin, and the like.

In addition, there can also be used a head wear preventing agent or a head sticking preventing agent such as higher fatty acid metal salts, e.g. zinc stearate, calcium stearate, etc., and waxes, e.g. paraffin, oxidized paraffin, polyethylene, oxidized polyethylene, stearamide, castor wax, etc. in the case of using as a heat-sensitive recording material; a dispersing agent such as sodium dioctyl sulfosuccinate, etc.; an ultraviolet light absorber such as benzophenones, benzotriazoles, etc.; surface active agents and fluorescent dyes.

As the support for the recording material of this invention, there can be used paper mainly as well as various non-woven fabrics, plastic films, synthetic paper, metal foils, etc., and composite sheets obtained by combining these materials.

The recording material of this invention can be used for ordinary facsimile machines, printers, and the like as well as for special use for detecting a near infrared light. When high storability of developed color images is desired, for example, when used as labels, a protective layer may be formed on a color forming layer in order to protect an undeveloped color portion and a developed color image portion from outside circumstances. In this case, the protective layer can be formed by using a water-soluble resin, latex, light-curable resin or the like conventionally used. If necessary, one or more pigments, water resistance improving agents, water repellents, antifoamers, ultraviolet light absorbers, etc., may be added thereto. Further, in the case of using for labels, an adhesive layer may be formed on a rear side of a support, so that the support can be adhered to a surface of another solid material after printed. In this case, a release paper is placed on the adhesive layer.

The color forming layer may take a single layer structure or a multi-layer structure containing a plurality of layers. In the case of the multi-layer structure, one or more intermediate layers may be interposed among individual layers. The color forming layer can be obtained by making aqueous dispersions of finely ground individual color forming components, mixing these dispersions with a binder and other additives depending on purposes, coating the resulting mixture on a support, followed by drying. It is also possible to coat each color forming component on a support, respectively, to form a multi-layer structure.

This invention is illustrated by way of the following Examples, in which all percents are by weight unless otherwise specified.

EXAMPLE 1

3,6-Bis(dimethylamino)fluorene-9-spiro-3'-(6'-dimethylaminophthalide) in an amount of 20 g and 80 g of a 1% polyvinyl alcohol aqueous solution were balled milled to form a dispersion. Then, 50 g of bis(3-allyl-4-hydroxyphenyl)sulfone and 200 g of a 1% polyvinyl alcohol aqueous solution were balled milled to form a dispersion. On the other hand, 10 g of 1,3-dimino-4,5,6,7-tetrachloroisoindoline and 40 g of a 1% polyvinyl alcohol aqueous solution were balled milled for 24 hours to form a dispersion. Then, 10 g of 4,4',4''-triisocyanate-2,5-dimethoxytriphenylamine and 40 g of a 1% polyvinyl alcohol aqueous solution were balled milled for 24 hours to form a dispersion. These dispersions were mixed and added with 250 g of a 40% calcium carbonate dispersion, 50 g of a 30% zinc stearate dispersion, and 400 g of a 10% polyvinyl alcohol aqueous solution to give a coating liquid with sufficient stirring. The coating liquid was coated on a base paper having a basis weight of 55 g/m$^2$ so as to make the coating amount 6 g/m$^2$ on solids content, and dried to give a heat-sensitive recording material.

EXAMPLE 2

The process of Example 1 was repeated except for using 1,4-diisocyanate-2,5-diethoxybenzene in place of 4,4',4''-triisocyanate-2,5-dimethoxytriphenylamine to give a heat-sensitive recording material.

EXAMPLE 3

The process of Example 1 was repeated except for using 4,4'-thiobisphenol in place of bis(3-allyl-4-hydroxyphenyl)sulfone to give a heat-sensitive recording material.

COMPARATIVE EXAMPLE 1

The process of Example 1 was repeated except for not using 1,3-diimino-4,5,6,7-tetrachloroisoindoline and 4,4',4''-triisocyanate-2,5-dimethoxytriphenylamine to give a heat-sensitive recording material.

COMPARATIVE EXAMPLE 2

The process of Example 3 was repeated except for not using 1,3-diimino-4,5,6,7-tetrachloroisoindoline and 4,4',4''-triisocyanate-2,5-dimethoxytriphenylamine to give a heat-sensitive recording material.

EXAMPLE 4

The process of Example 1 was repeated except for using 3-dimethylamino-6-diethylaminofluorene-9-spiro-3'-(6'-dibutylaminophthalide) in place of 3,6-bis-(dimethylamino)fluorene-9-spiro-3'-(6'-dimethylaminophthalide) to give a heat-sensitive recording material.

COMPARATIVE EXAMPLE 3

The process of Example 1 was repeated except for not using 3,6-bis(dimethylamino)fluorene-9-spiro- 3'-(6'-dimethylaminophthalide) and bis(3-allyl-4-hydroxyphenyl)sulfone to give a heat-sensitive recording material.

The heat-sensitive recording materials obtained in Examples 1 to 4 and Comparative Examples 1 to 3 were subjected to the following tests:

(1) Developed color density

Using a heat-sensitive paper printing tester (mfd. by Matsushita Electronic Components Co., Ltd.), printing was carried out under conditions of applied pulse of 3.0 millisec. and applied voltage of 16.00 volts. The density of obtained developed color image was measured by using a Macbeth densitometer RD 918.

(2) Light resistance of image

The developed color image obtained in above (1) was retained inside the window glass at a south side and exposed to sunlight for 12 days. Densities before and after the test were measured in the same manner as in above (1) to give the image retention rate by the following equation:

$$\text{Image retention rate} = \frac{\text{Density after exposure to sunlight}}{\text{Density before exposure to sunlight}} \times 100\ (\%)$$

(3) Near infrared light reading-out

Using a bar code printing apparatus (mfd. by Ishida Scales MFG. Co., Ltd.), printing was carried out at 22.7 volts. The printed matter was subjected to sunlight exposure in the same manner as described in above (2).

Goodness of reading out of the bar code before and after the test was examined by using a light pen for reading bar codes having a wavelength of about 960 nm (mfd. by Nippon Electric Industry Co., Ltd.).

The results are shown in the following Table

TABLE 1

| Example No. | Developed color density | Light resistance (%) | Near infrared light reading-out | |
|---|---|---|---|---|
| | | | Before test | After test |
| Example 1 | 0.98 | 67.2 | Good | Good |
| Example 2 | 1.04 | 70.1 | Good | Good |
| Example 3 | 0.96 | 68.0 | Good | Good |
| Example 4 | 0.98 | 67.8 | Good | Good |
| Comparative Example 1 | 1.05 | 8.0 | Good | Poor |
| Comparative Example 2 | 1.00 | 8.3 | Good | Poor |
| Comparative Example 3 | 0.90 | 98.6 | Poor | Poor |

What is claimed is:

1. A recording material which comprises a color forming layer containing a color forming system comprising (A) (a) a colorless or light-colored dye precursor represented by the formula:

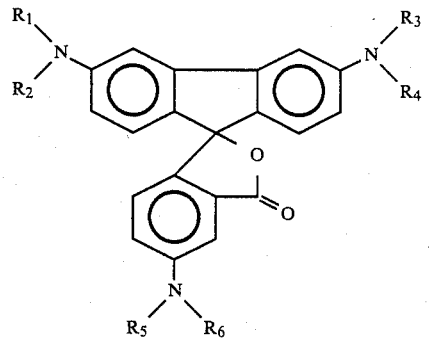

(I)

wherein $R_1$ through $R_6$ are independently a lower alkyl group, (b) a color developer which can form a color by reacting with the dye precursor and is a sulfur-containing phenolic derivative, and (B) (c) an isocyanate compound having aromaticity, and (d) an imino compound having at least one

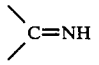

group, said color forming layer being carried on a support.

2. A recording material according to claim 1, wherein the dye precursor a) is 3,6-bis(dimethylamino)-fluorene-9-spiro-3,-(6,-dimethylaminophthalide) or 3-dimethylamino-6-diethylaminofluorene-9-spiro-3,-(6,'-dibutylaminophthalide).

3. A recording material according to claim 1, wherein the isocyanate compound (c) is triisocyanate-2,5-dimethoxytriphenylamine or 1,4-diisocyanate-2,5-diethoxybenzene.

4. A recording material according to claim 1, wherein the imino compound (d) is a compound of the formula:

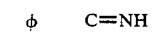

(II)

wherein $\phi$ is an aromatic compound residue which can form a conjugated system with the neighboring C═N.

5. A recording material according to claim 1, wherein the imino compound (d) is 1,3-diimino-4,5,6,7-tetrachloroisoindoline.

6. A recording material according to claim 1, wherein the color developer (b) is used in an amount of 20 to 500% by weight, the isocyanate compound (c) is used in an amount of 1% by weight or more, and the imino compound (d) is used in an amount of 1% by weight or more, based on the weight of the dye precursor (a).

7. A recording material according to claim 1, wherein the support is a composite multi-layer structure.

8. A recording material according to claim 1, wherein the sulfur-containing phenolic derivative is at least one member selected from the group consisting of bis(4-hydroxyphenyl) sulfone, 4-hydroxy-4,-methyldiphenylsulfone, 4-hydroxy-4,-isopropyloxydiphenylsulfone, bis (3-allyl-4-hydroxyphenyl) sulfone, bis (3-methyl-4-hydroxyphenyl) sulfone, bis (3-butyl-4-hydroxyphenyl)sulfone, bis (3,5-diallyl-4-hydroxyphenyl) sulfone, bis (3-chloro-4-hydroxyphenyl) sulfone, 3-allyl-4,4'-dihydroxydiphenylsulfone, bis(2-ethyl-4-hydroxyphenyl)sulfone, 3-isopropyl-4,4'-dihydroxydiphenylsulfone, bis(2,5-dimethyl-4-hydroxyphenyl) sulfone, bis(2,5-dichloro-4-hydroxyphenyl)sulfone, 4,4'-thiobis(2,5-dichlorophenol), 4,4'-thiodiphenol, 2,2'-thiobis(4-chlorophenol), 2,2'-thiobis(4,6-dichlorophenol), 4,4'-thiobis(2,6-dimethylphenol), 4,4'thiobis-(2,5-dimethylphenol), 4,4'-thiobis(2-isopropyl-5-methylphenol), 4,4'-thiobis(2-cyclohexylphenol), 4,4'-thiobis (2-isopropylphenol), 4,4'-thiobis(3-ethylphenol), and 4,4''-thiobis (2-t-butyl-5-methylphenol).

9. A recording material according to claim 1, wherein the sulfur-containing phenolic derivative is bis(3-allyl-4-hydroxyphenyl)sulfone or 4,4'-thiobisphenol.

* * * * *